United States Patent [19]

Cooper et al.

[11] Patent Number: 5,045,177

[45] Date of Patent: Sep. 3, 1991

[54] DESULFURIZING IN A DELAYED COKING PROCESS

[75] Inventors: John C. Cooper, Beaumont; James H. Colvert, Houston, both of Tex.

[73] Assignee: Texaco Inc., White Plains, N.Y.

[21] Appl. No.: 567,517

[22] Filed: Aug. 15, 1990

[51] Int. Cl.[5] ..... C10G 9/14

[52] U.S. Cl. ..... 208/131; 208/97; 208/104; 423/228

[58] Field of Search ..... 208/131, 97, 100, 102, 208/104; 423/228, 243

[56] References Cited

U.S. PATENT DOCUMENTS

| | | | |
|---|---|---|---|
| 3,907,664 | 9/1975 | Janssen et al. | 208/80 |
| 4,036,736 | 7/1977 | Ozaki et al. | 208/131 X |
| 4,058,451 | 11/1977 | Stolfa | 208/97 |
| 4,176,047 | 11/1979 | Orrell | 208/131 X |
| 4,292,165 | 9/1981 | Sooter | 208/131 X |
| 4,332,671 | 6/1982 | Boyer | 208/131 X |
| 4,385,982 | 5/1983 | Anderson | 208/131 X |
| 4,551,158 | 11/1985 | Wagner et al. | 423/228 X |
| 4,553,984 | 11/1985 | Volkamer et al. | 423/228 X |
| 4,686,027 | 8/1987 | Bonilla et al. | 208/39 |
| 4,894,144 | 1/1990 | Newman et al. | 208/131 |

*Primary Examiner*—Curtis R. Davis
*Assistant Examiner*—William C. Diemler
*Attorney, Agent, or Firm*—Jack H. Park; Kenneth R. Priem; Richard A. Morgan

[57] ABSTRACT

An improvement has been found in the gas recovery section of a delayed coking process. In the improvement the compressor discharge is amine scrubbed to remove hydrogen sulfide. The compressor discharge is the entire vapor feed to the gas recovery section and contains about 90% of the hydrogen sulfide. This has been found to cause a significant drop in both the depropanizer and debutanizer pressure and allow a saving in the investment cost of the pressure vessel. Synergistically a reduced amount of hydrogen sulfide is present in the entire gas recovery section. The remaining 10% of the hydrogen sulfide is removed by amine scrubbing the fuel gas and propane/propylene fractions.

9 Claims, 1 Drawing Sheet

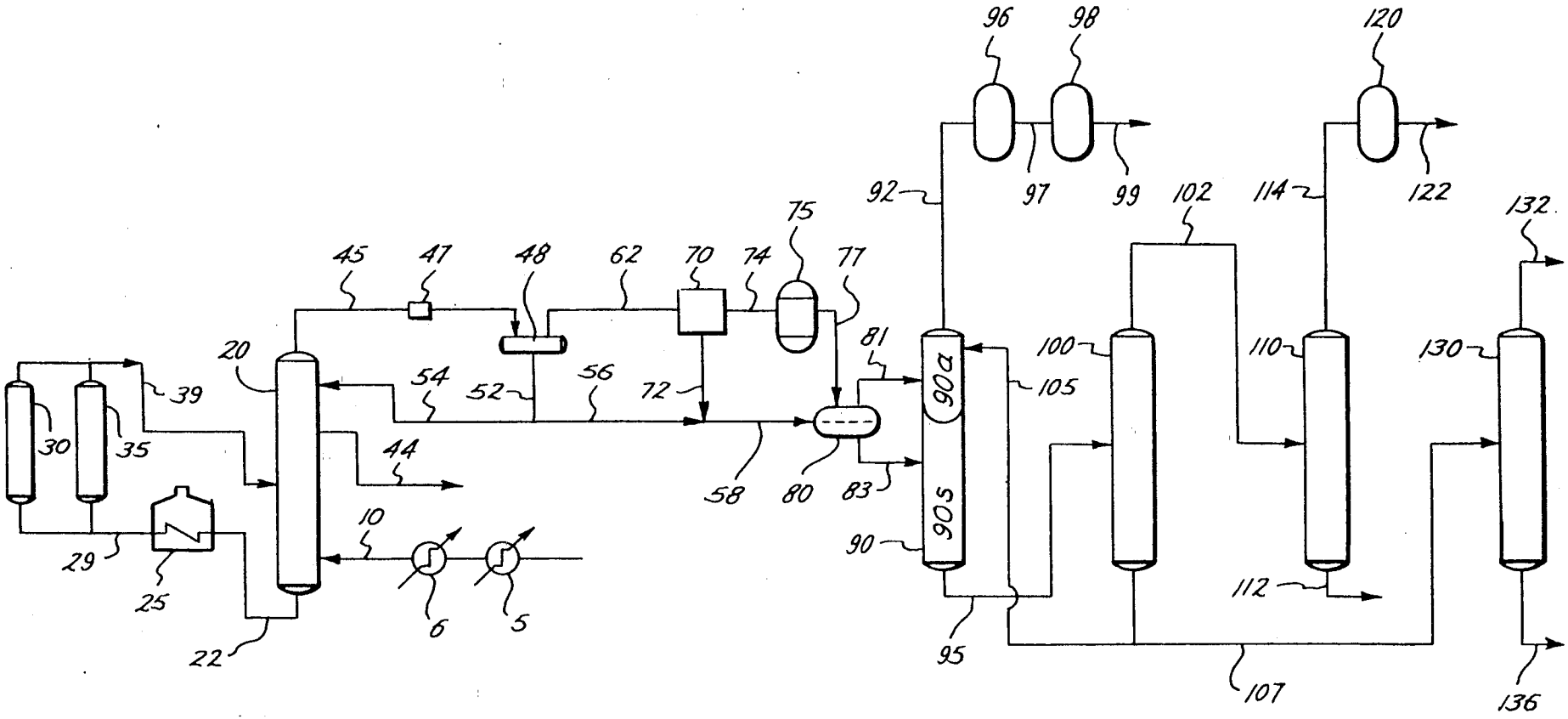
132
136
130
122
120
114
110
112
107
102
99
98
100
105
97
96
90a
90s
95
92
81
83
90
77
80
75
74
58
70
72
62
56
48
52
5
47
54
6
44
45
10
20
22
39
25
35
29
30

DESULFURIZING IN A DELAYED COKING PROCESS

BACKGROUND OF THE INVENTION

1. Field Of The Invention

The invention relates to a petroleum refining process. More particularly, the invention relates to a delayed coking process for converting a high sulfur, residual oil feedstock to coke and hydrocarbon liquids and gases. Most particularly the invention relates to separating and desulfurizing liquid and gaseous products of delayed coking.

2. Description Of Other Related Methods In The Field

In a delayed coking process, a heavy liquid hydrocarbon fraction is converted to solid coke and lower boiling liquid and gaseous products. The fraction is typically a residual petroleum based oil or a mixture of residual oil with other heavy fractions.

In a typical delayed coking process, the residual oil is heated by exchanging heat with liquid products from the process and is fed into a fractionating tower wherein light end products are removed from the residual oil. The oil is then pumped from the bottom of the fractionating tower through a tube furnace where it is heated under pressure to coking temperature and discharged into a coking drum.

In the coking reaction the residual feedstock is thermally decomposed into solid coke, condensable liquid and gaseous hydrocarbons. The solid coke is recovered. Coke quality determines its use. High purity coke is used to manufacture electrodes for the aluminum and steel industry. Lower purity coke is used for fuel; its value calculated based on the sulfur and heavy metal impurities which are transferred from the feedstock to the coke.

The liquid and gaseous hydrocarbons are removed from the coke drum and returned to the fractionating tower where they are separated into the desired hydrocarbon fractions.

U.S Pat. No. 4,332,671 to L. D. Boyer teaches a delayed coking process in which a heavy high-sulfur crude oil is first atmospheric distilled and then vacuum distilled to produce feedstock for delayed coking. Vapor and liquid products of delayed coking are subjected to hydrotreating to yield lower sulfur liquid and gas products.

U.S. Pat. No. 3,907,664 to H. R. Janssen et al. teaches a control system for a delayed coker fractionator. In particular, a coker fractionator overhead vapor fraction is condensed. The uncondensed vapor is passed from the accumulator to gas recovery. A portion of the condensed liquid is used to reflux the coker fractionator. The remaining portion of condensed liquid is passed to gas recovery.

U.S. Pat. No. 4,686,027 to J. A. Bonilla et al. teaches a delayed coker process. An overhead fraction from the coker fractionator is cooled, compressed and passed to an absorber/stripper. The vapor product of the absorber/stripper is a fuel gas stream. Fuel gas typically comprises methane and ethane.

The liquid product of the absorber/stripper is passed to a stabilizer which produces a $C_3/C_4$ overhead product and total naphtha as a bottoms product.

SUMMARY OF THE INVENTION

In a delayed coking process, a sour residual oil feedstock is converted to coke, liquid and sweet gas fractions. In the process a feedstock containing at least about 4 wt % sulfur is subjected to coking conditions, thereby effecting the conversion to coke and hydrocarbon fluids comprising sour liquid and sour gas. The sour fluids are separated from the solid coke and passed to a coker fractionator. In the coker fractionator at least three fractions are made: a gas fraction, a naphtha and lighter liquid fraction and a heavy liquid fraction.

The entire gas fraction is desulfurized before any subsequent processing. The naphtha and lighter liquid fraction is fractionated to yield a propane gas/liquid fraction and a liquid naphtha fraction. The propane fraction is desulfurized.

In processing sour coker feedstocks a substantial portion of the sulfur is converted to hydrogen sulfide gas. High sulfur feedstocks cause larger amounts of hydrogen sulfide gas to be produced which causes overloading of the depropanizer and debutanizer towers of the gas fractionation and recovery section of a delayed coker process. Applicants have discovered that desulfurizing the entire gas fraction from the coker fractionator significantly reduces the pressure in the downstream depropanizer and debutanizer towers. In the design and construction Of a delayed coker process this discovery allowed for depropanizer and debutanizer vessels of reduced pressure capacity to be built. It also allowed for reducing the size of most downstream processing equipment.

Synergistically, removing hydrogen sulfide upstream provided a safety benefit. Any leaking downstream hydrocarbon contains a significantly reduced amount of hydrogen sulfide gas. Heretofore, leaking hydrocarbon contained high concentrations of poisonous hydrogen sulfide gas because sulfur was amine scrubbed downstream on each vapor product stream.

BRIEF DESCRIPTION OF THE DRAWING

The drawing is a process flow diagram of a delayed coking process with fractionation facilities for gas and liquid recovery.

DETAILED DESCRIPTION OF THE DRAWING

In the drawing a petroleum feedstock which is the bottoms product of both atmospheric distillation and vacuum distillation is heated with heat integration in heat exchangers 5 and 6 and passed through line 10 to the lower portion of coker fractionator 20.

Essentially all of this feedstock passes out the bottom of coker fractionator 20, via line 22 to tube furnace 25. The feedstock is heated in tube furnace 25 under pressure to coking temperature and then passed rapidly to either one of two coke drums 30 and 35.

Coke drums 30 and 35 are operated cyclically. One drum, e.g. coke drum 30, is filled with feedstock via line 29 and coked, producing condensable hydrocarbon liquids and vapors. The other drum, e.g. coke drum 35, is emptied of coke, and readied for refilling. Coke is withdrawn from the lower end of coke drum 35 by removing the lower head (not shown). Hydrocarbon condensable liquids and vapors are continuously withdrawn via conduit 39 and passed to coker fractionator 20.

The coking reaction is a thermal decomposition of petroleum residuum feedstock. This reaction is carried out at temperatures of 900° F. to 1000° F. and pressures of 1 atm to 8 atm. Although large quantities of coke are produced, the premium product of the coking process is the hydrocarbon condensable liquids and vapors. The hydrocarbon products include in various proportions, the full range of hydrocarbons from methane and ethane to a heavy coker gas oil consisting of a 650° F. to 800° F. fraction. Hydrocarbon liquids boiling above about 800° F. are passed via line 22 back to coke drums 30 and 35.

Boiling between the methane-ethane fraction and the heavy coker gas oil fraction are a number of intermediate boiling components which are taken as fractions selected by product demand and the refining equipment available to recover them. These products include fuel gas, propane/propylene, butane/butylene, light naphtha, heavy naphtha, a light coker gas oil boiling between 400° F. and 650° F., and the heavy coker gas oil boiling above 650° F.

A number of liquid fractions can be withdrawn as side streams from the coker fractionator. This is generically shown as side stream 44. Multiple side streams may be taken for fractions such as light coker gas oil and heavy coker gas oil, represented by side stream 44. Such a configuration is shown by example in U.S. Pat. No. 4,686,027 to J. A. Bonilla et al. incorporated herein by reference.

The invention is useful for high sulfur petroleum residuum feedstocks. High sulfur and very sour are defined herein as stocks containing 4 wt % or more sulfur, typically 5 wt % or more. This amount of sulfur can be even higher, e.g. 8 wt %. The commercial value of a feedstock generally diminishes with an increased amount of sulfur. This is attributable in large part to the requirement to remove the sulfur from products. Sulfur from the feedstock is distributed to some extent among all the products from methane to coke. A substantial portion of the sulfur is converted in the delayed coking process to hydrogen sulfide. Hydrogen sulfide predominates in the $C_1$ to $C_3$ boiling products because of its boiling point.

A wide boiling range overhead fraction is taken from coker fractionator 20 via line 45. The fraction passes through air fin condenser and cooler 47 which condenses a substantial portion of the fraction forming a mixed vapor/liquid mixture which is passed to accumulator 48. Essentially all of the hydrogen sulfide produced in coke drums 30 and 35 passes through accumulator 48. For this discussion the material balance for hydrogen sulfide is made around accumulator 48. This is an analytical technique and it is understood that hydrogen sulfide is produced in coke drums 30 and 35 and passes through coker fractionator 20 to accumulator 48. It is also understood that minor amounts of sulfur are in forms other than hydrogen sulfide. For example, sulfur in the form of mercaptans is also present. However, this discussion concerns only sulfur passing through accumulator 48 in the form of hydrogen sulfide.

A portion of the hydrocarbon liquid from accumulator 48 is returned to coker fractionator 20 as reflux under temperature control via line 52 and reflux line 54. The remaining sour liquid passes under level control via line 52, line 56 and line 58 to accumulator 80.

The vapor from accumulator 48 passes under pressure control via line 62 to compressor station 70. In compressor station 70 the vapor is compressed in the first of two stages from about 2-25 psig to 50-100 psig. This first stage compressed vapor is cooled to a temperature of 90° F.-120° F. to condense additional liquid which is removed via line 72. The remaining vapor is compressed in the second stage to a pressure of 175 psig to 250 psig. The compressed vapor is then cooled to 90° F.-120° F. to condense additional liquid which is removed via line 72. The vapor passes via line 74 to sulfur removal means 75. The combined liquid passes via line 72 and line 58 to accumulator 80.

Sulfur removal means comprises any of the industrial processes for removing hydrogen sulfide from a flowing hydrocarbon stream. In the petroleum refining industry this is typically an amine scrubbing unit operation in which the vapor or liquid hydrocarbon stream is contacted countercurrently with a lean aqueous solution of alkanol amine in an absorber vessel. The two alkanol amines in wide commercial use for this purpose are monoethanolamine (MEA) and diethanolamine (DEA). Triethanolamine (TEA) and methyldiethanolamine (MDEA) have also been used for this purpose. The lean aqueous alkanol amine absorbs acid gases comprising primarily hydrogen sulfide and lesser amounts of carbon dioxide from the hydrocarbon stream. The acid rich stream is passed to a stripper vessel in which the aqueous amine solution is reactivated by stream stripping acid gases from the aqueous alkanol amine solution.

Over 90% of the hydrogen sulfide produced in the process from the feedstock is removed in sulfur removal means 75. The sour hydrocarbon is contacted countercurrently with a lean aqueous amine solution. Theoretically the treating rate could be an equimolar amount of amine with the hydrogen sulfide. For practical considerations, an amount of amine in molar excess of the hydrogen sulfide is used. For MEA, the design treating rate for a 15 vol % aqueous MEA solution is 4 lb mole MEA/lb mole hydrogen sulfide at 100° F. to 120° F. This treating rate may be adjusted based on the amine selected, design experience and economy. An essentially sulfur free hydrocarbon vapor (e.g. containing 10 to 1000 ppm by weight hydrogen sulfide) is passed via line 77 to accumulator 80 where it is recombined with sour hydrocarbon liquid from accumulator 48 and hydrocarbon liquid from compressor station 70.

Accumulator 80 is maintained at a pressure of 175 psig to 250 psig and temperature of 90° F. to 120° F. At these conditions the hydrocarbon separates into liquid and vapor phases. Both liquid and vapor phases are passed to absorber/stripper 90. Absorber/stripper 90 includes an absorber **90*a* in its upper section and a stripper 90*s* in its lower section. Vapor flows from accumulator 80 via line 81 to absorber 90*a* where it is contacted with wash oil (debutanized total naphtha) via line 105. The wash oil serves to absorb relatively heavier hydrocarbons such as $C_3$'s and $C_4$'s leaving constituents such as methane, hydrogen, ethane, ethylene and other light hydrocarbon vapors which are taken overhead via line 92. This fraction is commonly termed fuel gas. This fuel gas contains amounts of hydrogen sulfide. The hydrogen sulfide in fuel gas is derived from the hydrogen sulfide dissolved in accumulator 48 liquid and passed via line 52, line 56, line 58, accumulator 80 and line 81 to absorber 90*a*. Fuel gas is passed via line 92 through sponge oil absorber 96. In sponge oil absorber 96 fuel gas is contacted with light coker gas oil to remove propane, butane and heavier hydrocarbons from the fuel gas. This is accomplished in a countercurrent liquid-vapor contactor containing, for example, 20 trays. The treating rate is determined by quality control analysis to bring about the removal of the heavy ends from the fuel gas. Sulfur removal means, such as the above described alkanol amine scrubbing unit operation, removes the remaining amounts of hydrogen sulfide. These amounts are only a minor proportion of the amount of hydrogen sulfide removed from the fuel gas in a conventional delayed coking process. Fuel gas passes via line 99** as a sweet product.

The relatively heavier liquid material from the absorber 90*a* passes to stripper 90*s*. Also, liquid from accumulator 80 passes by level control via line 83 to stripper 90*s*. Stripper 90*s* is used to strip ethane and lighter materials from the hydrocarbon liquids. The deethanized hydrocarbon liquids containing propane and heavier constituents up to whole naphtha is passed via line 95 to debutanizer 100. Debutanizer 100 is operated to remove a $C_3/C_4$ fraction which is passed overhead via line 102 to depropanizer 110. The bottoms product of debutanizer 100 is a total naphtha fraction. A portion of this total naphtha, as previously stated, is recycled via line 105 as wash oil to absorber/stripper 90. The remainder of the total naphtha is passed via line 107 to naphtha splitter 130. Naphtha splitter 130 fractionates the total naphtha into two fractions; a light naphtha having a nominal boiling range of 100° F. to 200° F. and a heavy naphtha having a nominal boiling range of 200° F. to 400° F. Light naphtha is passed via line 132 to product tankage. Heavy naphtha is passed via line 136 to product tankage.

Depropanizer 110 receives a fraction via line 102 consisting essentially of $C_3$'s, $C_4$'s and hydrogen sulfide. The sweet $C_4$ bottoms product is passed via line 112 to processing units (not shown) which will consume the entire stream in the manufacture of products such as methyl t-butyl ether (MTBE) and $C_8$ alkylate.

The overhead of depropanizer contains $C_3$'s and the remainder of the hydrogen sulfide passed through accumulator 48. The sulfur accumulates in the overhead $C_3$ fraction of depropanizer 110. The sulfur in depropanizer 110 overhead and fuel gas stream 92 typically comprises 10% or less of the total hydrogen sulfide yield from the process.

The $C_3$ fraction is passed via line 114 to sulfur removal means 120. Sulfur removal means 120 is identical in processing configuration and substantially smaller than the size of sulfur removal means 75. Sulfur removal means 120 is preferably an alkanol amine scrubbing unit operation. The $C_3$ vapor is contacted countercurrent with a down flowing aqueous solution of a selected alkanol amine. The commercially preferable alkanol amines are monoethanolamine or diethanolamine. The aqueous amine solution absorbs the acid hydrogen sulfide gas, producing a $C_3$ product stream via line 122. This $C_3$ product stream is sweet, e.g. 10 wppm to 1000 wppm hydrogen sulfide.

DESCRIPTION OF THE PREFERRED EMBODIMENTS

Delayed coking is a thermal cracking process used to convert petroleum resid factions into solid coke and more valuable liquid and vapor hydrocarbon fractions. The fuel gas to total naphtha boiling range hydrocarbons of this process are separated by distillation, absorption and other separation processes as described in the description of the drawing and are collectively referred to in the art as the gas recovery section of a delayed coking process. The gas recovery section produces separate fractions comprising fuel gas, propane/propylene, butane/butylene, light naphtha and heavy naphtha.

The feedstock to the gas recovery section is the coker fractionator overhead stream which contains amounts of hydrogen sulfide which are in proportion to the amount of sulfur in the petroleum resid feedstock. This hydrogen sulfide is undesirable in hydrocarbon products and therefore is removed. Hydrogen sulfide has a vapor pressure between that of ethane and propylene. Consistent with the vapor pressure, hydrogen sulfide is concentrated in the fuel gas (methane/ethane) and propane/propylene fractions. In a conventional delayed coking process, each product stream is treated individually to remove hydrogen sulfide. That is, fuel gas and propane/propylene fractions are amine scrubbed separately.

Applicants have discovered surprisingly that for a delayed coker unit processing very sour feedstocks, significant reduction in investment cost was achieved by the inventive sulfur removal processing instead of the conventional processing to remove sulfur. In practicing the invention, the entire compressor discharge is amine scrubbed to remove hydrogen sulfide. About 93% of the hydrogen sulfide which passes through the gas recovery section is removed at this point. Hydrogen sulfide in hydrocarbon liquid bypassing the compressor avoids removal at this point. This remaining hydrogen sulfide which amounts to about 7% is removed by amine scrubbing the depropanizer overhead stream and the fuel gas stream. These amine scrubbers are much smaller than in a conventional process.

The invention is particularly effective in subjecting very sour feedstocks to the delayed coking process. Very sour feedstocks are defined herein as containing 4 wt % or more sulfur. In treating very sour feedstocks, according to a conventional desulfurizing configuration, it has been found that the debutanizer tower overhead liquid contained 24.9 mole % hydrogen sulfide. This concentration required a tower pressure of 230 psig at 100° F. to condense the overhead product in order to reflux the tower and produce a liquid overhead product. This is contrasted with a 0.5 to 3.0 wt % sour feedstock wherein the debutanizer overhead (DB ovhd) liquid is less than 10 mole % hydrogen sulfide. At 100° F., the liquid is condensed at about 149 psig. The results of design calculations for a conventional configuration (absence of sulfur removal means 75) are as follows:

| Sulfur in Feed line 10 | $H_2S$ in DB ovhd line 102 | Debutanizer 100 |
|---|---|---|
| 2.03 wt % | 3.1 mole % | 160 psig @ 107° F. |
| 2.98 wt % | 6.6 mole % | 149 psig @ 100° F. |
| 5.31 wt % | 24.9 mole % | 230 psig @ 100° F. |

Accordingly, Applicants have discovered that investment cost is saved in the absorber 90*a*, debutanizer 100 and in the depropanizer 110 by amine scrubbing the compressor discharge to remove hydrogen sulfide. Although a larger amine scrubbing facility is required at this point, saving is realized in the absorber, the debutanizer and the depropanizer pressure vessels.

Synergistically, a real benefit to unit operating personnel is realized. The gas recovery section is greatly attenuated in hydrogen sulfide compared to the conventional processing configuration. Equipment leaks are correspondingly attenuated in hydrogen sulfide. The process is therefore inherently safer for operating personnel.

This invention is shown by way of Example.

EXAMPLE

Example 1 (Comparative)

Design calculations were made for a conventional gas recovery section of a delayed coking process. A conventional gas recovery section is characterized by the absence of sulfur removal means 75. The conventional gas recovery section includes sulfur removal means 98 and 120.

Sulfur removal was by amine scrubbing with 15% aqueous MEA at a treating rate of 4 lb mole MEA/lb mole hydrogen sulfide.

The design equipment specification and operating conditions are detailed in TABLE I.

Example 2

Design calculations were made for the inventive gas recovery section of a delayed coking process. The gas recovery section included sulfur removal means 75, 98 and 120.

Sulfur removal was by amine scrubbing with 15% aqueous MEA at a treating rate of 4 lb mole MEA/lb mole hydrogen sulfide.

The design equipment specification and operating conditions are detailed in TABLE II.

TABLE I

EXAMPLE 1 - No Sulfur Removal Means 75

| Equipment | Compressor Station 70 | Sulfur Removal 75 | Absorber 90a | Stripper 90s | Debutanizer 100 | Depro-anizer 110 | Sulfur Removal 120 | Sponge Oil 96 | Sulfur Removal 98 |
|---|---|---|---|---|---|---|---|---|---|
| Design Information | | | | | | | | | |
| Pressure, psig | | — | 220 | 220 | 310 | 330 | 250 | 205 | 195 |
| Temperature, °F. | | — | 300 | 500 | 490 | 280 | 200 | 200 | 200 |
| Inside Diameter | | — | 6'6" | 6'6",8"6" | 5'6",11"0" | 4'0" | 5'6" | 4'0" | 6'0" |
| Length, Tan-Tan | | — | 78'0" | 81'0" | 131'0" | 83'0" | 75'0" | 63'0" | 73'0" |
| Number of Trays | | — | 29 | 24 | 49 | 34 | 24 | 24 | 24 |
| | Line 74 hot | | Ovhd Line 92 | Btms Line 95 | Ovhd Line 102 | Ovhd Line 114 | Line 122 | Line 97 | Line 99 |
| Operating Conditions | | | | | | | | | |
| Pressure, psig | 195 | — | 177 | 194 | 230(1) | 260(1) | 200 | 172 | 165 |
| Temperature °F. | 263 | — | 100 | 310 | 100 | 100 | 110 | 105 | 115 |
| Rate, lb mole/hr | | | | | | | | | |
| $H_2S$ | 395.4 | — | 265.9 | 153.8 | 153.8 | 153.8 | 0.1 | 241.1 | 0.2 |
| C2 & Lighter | 1494.3 | — | 1507.7 | 6.7 | 6.7 | 6.7 | 6.7 | 1478.2 | 1478.2 |
| Total C3's | 270.0 | — | 30.9 | 267.6 | 267.6 | 257.7 | 257.7 | 26.9 | 26.9 |
| Total C4's | 143.4 | — | 2.8 | 201.3 | 186.8 | 4.2 | 4.2 | 1.8 | 1.8 |
| Total C5+ | 97.2 | — | 33.0 | 3300.4 | 3.1 | 0.0 | 0.0 | 1.5 | 1.5 |
| $H_2O$ | 36.7 | — | 9.2 | 0.1 | 0.1 | 0.1 | 1.0 | 8.8 | 12.7 |
| Total | 2437.0 | — | 1849.5 | 3929.9 | 618.1 | 422.5 | 269.7 | 1758.3 | 1521.3 |
| Liquid (L) or Vapor (V) | V | — | V | L | L | V | V | V | V |

'feet
"inches
(1)Overhead accumulator drum pressure

TABLE II

EXAMPLE 2 - With Sulfur Removal Means 75

| Equipment | Compressor Station 70 | | Sulfur Removal 75 | Absorber 90a | Stripper 90s | Debu-tanizer 100 | Depro-anizer 110 | Sulfur Removal 120 | Sponge Oil 96 | Sulfur Removal 98 |
|---|---|---|---|---|---|---|---|---|---|---|
| Design Information | | | | | | | | | | |
| Pressure, psig | | | 225 | 220 | 220 | 195 | 250 | 250 | 205 | 195 |
| Temperature, °F. | | | 200 | 300 | 500 | 490 | 260 | 200 | 200 | 200 |
| Inside Diameter | | | 8'0" | 5'6" | 6'6",8"6" | 5'0",8'6" | 3'6" | 3'0" | 3'6" | 3'6" |
| Length, Tan-Tan | | | 73'6" | 78'0" | 81'0" | 129'6" | 81'0" | 66'0" | 59'0" | 63'0" |
| Number of Trays | | | 24 | 29 | 24 | 49 | 34 | 24 | 24 | 24 |
| | Line 74 hot/cool* | | Line 77 | Ovhd Line 92 | Btms Line 95 | Ovhd Line 102 | Ovhd Line 114 | Line 122 | Line 97 | Line 99 |
| Operating Conditions | | | | | | | | | | |
| Pressure, psig | 200 | 195 | 190 | 177 | 194 | 149(1) | 210(1) | 200 | 172 | 165 |
| Temperature °F. | 266 | 100 | 110 | 100 | 338 | 100 | 108 | 118 | 101 | 110 |
| Rate, lb mols/hr | | | | | | | | | | |
| $H_2S$ | 374.1 | 367.6 | 0.3 | 21.6 | 8.3 | 8.3 | 8.3 | 0.0 | 19.4 | 0.2 |
| C2 & Lighter | 1497.1 | 1490.1 | 1490.1 | 1510.7 | 6.7 | 6.7 | 6.7 | 6.7 | 1478.1 | 1478.1 |
| Total C3's | 270.5 | 261.7 | 261.7 | 32.7 | 266.4 | 266.4 | 256.5 | 256.5 | 27.9 | 27.9 |
| Total C4's | 143.1 | 129.8 | 129.8 | 2.4 | 198.7 | 187.0 | 4.2 | 4.2 | 1.3 | 1.3 |
| Total C5+ | 96.2 | 53.0 | 53.0 | 29.9 | 2664.5 | 3.1 | 0.0 | 0.0 | 0.5 | 0.5 |
| $H_2O$ | 36.4 | 10.4 | 12.1 | 7.3 | 0.0 | 0.0 | 0.0 | 2.0 | 10.5 | 10.7 |
| Total | 2417.4 | 2312.6 | 1947.0 | 1604.6 | 3144.6 | 471.5 | 275.7 | 269.4 | 1537.7 | 1518.7 |

TABLE II-continued

| EXAMPLE 2 - With Sulfur Removal Means 75 | | | | | | | | | | |
|---|---|---|---|---|---|---|---|---|---|---|
| Liquid (L) or Vapor (V) | V | V | V | V | L | L | V | V | V | V |

'feet
"inches
*Temperature required for amine scrubbing
(1)Overhead accumulator drum pressure While particular embodiments of the invention have been described, it will be understood, of course, that the invention is not limited thereto since many modifications may be made, and it is, therefore, contemplated to cover by the appended claims any such modifications as fall within the true spirit and scope of the invention.

What is claimed is:

1. A delayed coking process for the conversion of high sulfur residual oil feedstock to coke, hydrocarbon liquid and sweet gas fractions, the process comprising the steps of:

a. coking the sour residual oil feedstock at coking conditions thereby converting the feedstock to coke and sour hydrocarbon fluids, b. separating the sour hydrocarbon fluids from the coke, c. fractionating the sour hydrocarbon fluids to yield a sour $C_1$-$C_4$ gas fraction, and a hydrocarbon liquid fraction, d. desulfurizing by amine scrubbing the entire sour $C_1$-$C_4$ gas fraction to yield a sweet $C_1$-$C_4$ gas fraction.

2. A delayed coking process for the conversion of sour residual oil feedstock to coke, hydrocarbon liquid and sweet gas fractions, said feedstock containing sulfur in amounts of 4 wt % and greater, the process comprising the steps of:

a. coking the sour residual oil feedstock to yield coke and sour hydrocarbon fluids, b. separating the sour hydrocarbon fluids from the coke, c. fractionating the sour hydrocarbon fluids to yield a sour $C_1$-$C_4$ gas fraction and a sour $C_3$+ liquid fraction, d. desulfurizing the sour $C_1$-$C_4$ gas fraction to yield a sweet $C_1$-$C_4$ gas fraction, e. fractionating the sour $C_3$+ liquid fraction to yield a sour $C_3$ fraction, f. desulfurizing the sour $C_3$ fraction to yield a sweet $C_3$ fraction.

3. The delayed coking process of claim 2 wherein in step d. desulfurizing is by amine scrubbing and in step f. desulfurizing is by amine scrubbing.

4. A delayed coking process for the conversion of sour residual oil feedstock to coke, hydrocarbon liquid and sweet gas fractions, said feedstock containing sulfur in amounts of 4 wt % and greater, the process comprising the steps of:

a. coking the sour residual oil feedstock at coking conditions thereby effecting the conversion to coke and sour hydrocarbon fluids, b. separating the sour hydrocarbon fluids from the coke, c. fractionating the sour hydrocarbon fluids to yield a sour $C_1$-$C_4$ gas fraction, a sour naphtha and lighter liquid fraction and a sour heavy liquid fraction, d. desulfurizing the sour $C_1$-$C_4$ gas fraction to yield a sweet $C_1$-$C_4$ gas fraction.

e. fractionating the sour naphtha and lighter liquid fraction to yield a sour $C_3$ fraction, f. desulfurizing the sour $C_3$ fraction to yield a sweet $C_3$ fraction.

5. The delayed coking process of claim 4 wherein in step d. desulfurizing is by amine scrubbing and in step f. desulfurizing is by amine scrubbing.

6. A delayed coking process for the conversion of sour residual oil feedstock to coke, liquid and sweet gas fractions, said feedstock containing amounts of sulfur of 4 wt % and greater, the process comprising the steps of:

i. coking the sour residual oil feedstock at coking conditions thereby effecting the conversion to coke and sour hydrocarbon fluids, ii. separating the sour hydrocarbon fluids from the coke and, iii. fractionating the sour hydrocarbon fluid into a sour $C_1$-$C_4$ gas fraction, a sour naphtha and lighter liquid fraction and a sour heavy liquid fraction, iv. desulfurizing the sour $C_1$-$C_4$ gas fraction to yield a sweet $C_1$-$C_4$ gas fraction, v. combining the sweet $C_1$-$C_4$ gas fraction with the sour naphtha and lighter liquid fraction and fractionating to yield a $C_1$-$C_2$ gas fraction and a sour liquid fraction, vi. fractionating the sour liquid fraction to yield a sour $C_3$ fraction, a $C_4$ liquid fraction and a $C_5$-naphtha liquid fraction, vii. desulfurizing said sour $C_3$ fraction to yield a sweet $C_3$ fraction, viii. passing a portion of the $C_5$-naphtha liquid fraction from step vi. to step v. as reflux in said fractionating.

7. The process of claim 6 wherein in step iv. desulfurizing is by amine scrubbing and in step vii desulfurizing is by amine scrubbing.

8. A delayed coking process for the conversion of sour residual oil feedstock to coke, hydrocarbon liquid and sweet gas fractions, said feedstock containing sulfur in amounts of 4 wt % and greater, the process comprising the steps of:

a. coking the sour residual oil feedstock to yield coke and sour hydrocarbon fluids, b. separating the sour hydrocarbon fluids from the coke, c. fractionating the sour hydrocarbon fluids to yield a sour $C_1$-$C_4$ fraction and a sour $C_3$+ liquid fraction, d. desulfurizing the sour $C_1$-$C_4$ fraction to yield a sweet $C_1$-$C_4$ fraction, e. combining the sweet $C_1$-$C_4$ fraction with the sour $C_3$+ liquid fraction and fractionating to yield a $C_1$-$C_2$ gas fraction, f. desulfurizing the $C_1$-$C_2$ gas fraction to yield a sweet $C_1$-$C_2$ gas fraction.

9. The delayed coking process of claim 8 wherein in step d. desulfurizing is by amine scrubbing and in step f. desulfurizing is by amine scrubbing.

* * * * *